US009449770B2

(12) United States Patent
Sanford et al.

(10) Patent No.: US 9,449,770 B2
(45) Date of Patent: Sep. 20, 2016

(54) SHIMLESS BUTTON ASSEMBLY FOR AN ELECTRONIC DEVICE

(71) Applicant: Apple Inc., Cupertino, CA (US)

(72) Inventors: Emery A. Sanford, San Francisco, CA (US); Tyson B. Manullang, Sunnyvale, CA (US)

(73) Assignee: APPLE INC., Cupertino, CA (US)

( * ) Notice: Subject to any disclaimer, the term of this patent is extended or adjusted under 35 U.S.C. 154(b) by 142 days.

(21) Appl. No.: 14/178,800

(22) Filed: Feb. 12, 2014

(65) Prior Publication Data

US 2015/0228423 A1 Aug. 13, 2015

(51) Int. Cl.
*H01H 13/14* (2006.01)
*H01H 13/705* (2006.01)

(52) U.S. Cl.
CPC ..... *H01H 13/14* (2013.01); *H01H 13/705* (2013.01); *H01H 2221/042* (2013.01); *H01H 2221/044* (2013.01); *H01H 2221/062* (2013.01)

(58) Field of Classification Search
CPC ..... H01H 13/14; H01H 1/10
USPC ..... 200/5 A, 512, 520
See application file for complete search history.

(56) References Cited

U.S. PATENT DOCUMENTS

| | | | | |
|---|---|---|---|---|
| 4,258,096 | A * | 3/1981 | LaMarche | B32B 5/18 200/5 A |
| 4,345,119 | A * | 8/1982 | Latasiewicz | H01H 13/702 200/306 |
| 4,922,070 | A * | 5/1990 | Dorinski | H01H 13/702 200/512 |
| 6,963,039 | B1 | 11/2005 | Weng et al. | |
| 8,263,886 | B2 | 9/2012 | Lin et al. | |
| 8,446,713 | B2 | 5/2013 | Lai | |
| 2012/0067711 | A1 | 3/2012 | Yang | |
| 2013/0087443 | A1 * | 4/2013 | Kikuchi | H01H 13/48 200/520 |

FOREIGN PATENT DOCUMENTS

KR 20080045397 5/2008

* cited by examiner

*Primary Examiner* — Edwin A. Leon
*Assistant Examiner* — Iman Malakooti
(74) *Attorney, Agent, or Firm* — Brownstein Hyatt Farber Schreck, LLP

(57) ABSTRACT

Embodiments of the present disclosure are directed to a shimless button assembly. According to such embodiments, a shimless button assembly includes a button component and a switch mechanism. The button component includes a compressible member that is configured to expand and contract in order to occupy a volume of space between the button component and the switch mechanism. The volume of space between the button component and the switch mechanism may be caused by differing tolerances between the various components of the button assembly, such as, for example, the button component and the switch mechanism.

20 Claims, 5 Drawing Sheets

SHIMLESS BUTTON ASSEMBLY FOR AN ELECTRONIC DEVICE

TECHNICAL FIELD

The present disclosure is directed to a shimless button assembly for an electronic device. Specifically, one or more embodiments of the present disclosure are directed to a shimless button assembly that biases a button assembly to a switch regardless of varying part tolerances of each of the components of the button assembly.

BACKGROUND

Some computing devices, particularly portable computing devices, have tactile button interfaces. In such computing devices, the feel of the tactile button can greatly impact a user's perception of the quality of the computing device as a whole. For example, if the tactile button is too loose or too tight when actuated by a user, the user may perceive the computing device as poorly or cheaply manufactured.

It is with respect to these and other general considerations that embodiments have been made. Also, although relatively specific problems have been discussed, it should be understood that the embodiments should not be limited to solving the specific problems identified in the background.

SUMMARY

This summary is provided to introduce a selection of concepts in a simplified form that are further described below in the Detailed Description section. This summary is not intended to identify key features or essential features of the claimed subject matter, nor is it intended to be used as an aid in determining the scope of the claimed subject matter.

One or more embodiments of the present disclosure provide a shimless button assembly. According to these embodiments, the shimless button assembly includes a button component and a switch mechanism. The button component includes a compressible member that is configured to expand and contract in order to occupy a volume between the button component and the switch mechanism. In embodiments, the volume between the button component and the switch mechanism is caused by a tolerance stack associated with the button component and the switch mechanism.

The present disclosure also provides a shimless button assembly according to one or more additional embodiments. In these embodiments, the button assembly comprises a button component and a switch mechanism. The switch mechanism may be coupled to an expansion component. In embodiments, the expansion component includes a compressible member configured to expand and contract to occupy a volume of space that exists between the button component and the switch mechanism. The volume of space that exists between the button component and the switch mechanism may be caused by a tolerance stack associated with the button component and the switch mechanism.

One or more embodiments also provide a method for biasing a button assembly. According to this method, a compressible member is coupled to a contact plate and is used to bias the contact plate to a switch mechanism. Once the contact plate comes in to contact with the switch mechanism, a glue layer may be inserted into an area defined by the compressible member. When the glue layer hardens, the hardened glue layer causes the compressible member to hold the bias established between contact plate and the switch mechanism.

DETAILED DESCRIPTION

Figure 1:
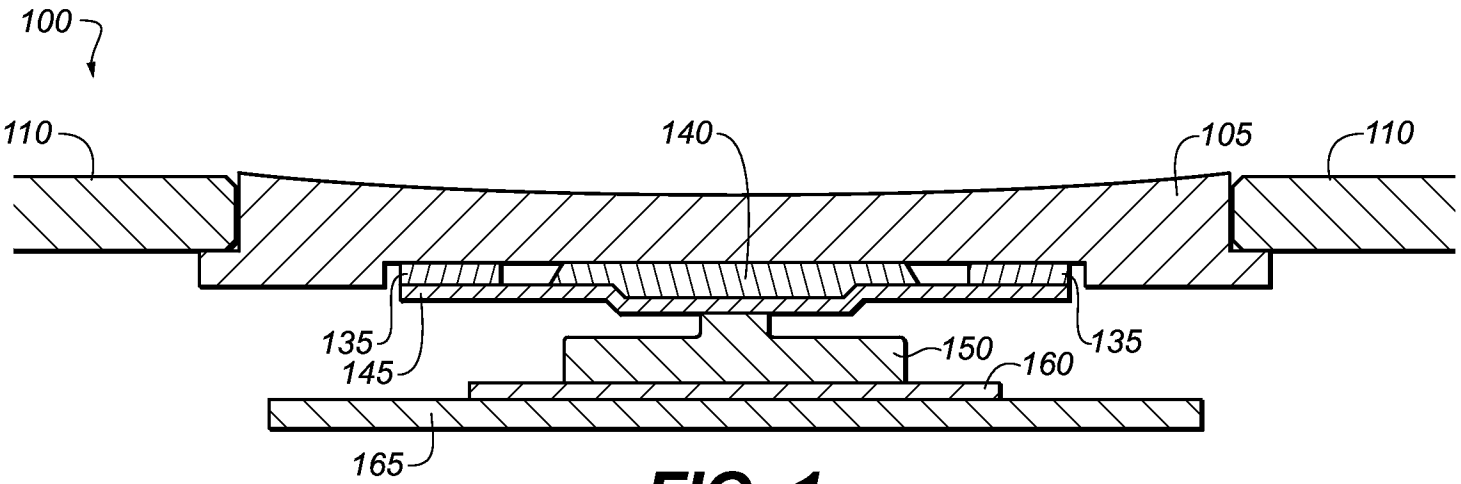
FIG. 1 illustrates a shimless button assembly according to one or more embodiments of the present disclosure.

Various embodiments are described more fully below with reference to the accompanying drawings, which form a part hereof, and which show specific exemplary embodiments. However, embodiments may be implemented in many different forms and should not be construed as limited to the embodiments set forth herein; rather, these embodiments are provided so that this disclosure will be thorough and complete, and will fully convey the scope of the embodiments to those skilled in the art. The following detailed description is, therefore, not to be taken in a limiting sense.

One or more embodiments of the present disclosure are directed to a shimless button assembly. Typical button assemblies have various components. For example, a button assembly may have a contact plate that is configured to interact with a switch mechanism when the button is actuated by a user. However, due to differing tolerances between various components of the button assembly, the contact plate may be biased too much against the switch mechanism or too little against the switch mechanism. The differences in the bias may cause the feel of the button to differ from device to device.

For example, a contact plate in a first button assembly may have a first thickness while a contact plate in a second button assembly may have a second thickness that is different from the first thickness. Likewise, the other components of the button assembly may also have thicknesses that vary from assembly to assembly.

A shim may allow for fine tuning of some button assemblies. However, even with shims, in some cases the button, or a component of the button, may be biased too much against the switch or too little against the switch. This deviation may be caused by different part tolerances of each component of the button assembly such as explained above or by different tolerances of the shims themselves.

As will be explained in detail below, the button assembly of the present disclosure is configured to bias one component of a button assembly to another component of the button assembly without the use of a shim. For example, the button assembly of the present disclosure is configured to enable components of the button assembly to be substantially flush or coplanar with respect to a relationship between the surfaces of at least two components. In an embodiment, the button assembly includes a compressible member that is configured to expand and contract to occupy a volume of space within the button assembly.

Specifically, the compressible member may be made from a soft foam-like material or a soft rubber-like material. The compressible member may be compressed and placed in the button assembly. Once placed in the button assembly, the compressible member may exert a force on a first button component until the first button component comes into contact with a second button component. Once the first button component comes into contact with the second button component, a glue layer is added within an area defined by the compressible member. When the glue layer hardens, the glue layer prevents the compressible member from further expansion and contraction even when the button is subsequently actuated by a user. As a result, the compressible member will continue to occupy the volume of space in the button assembly.

FIG. 1 illustrates a shimless button assembly 100 according to one or more embodiments of the present disclosure. The shimless button assembly 100 of the present disclosure may be used in a variety of computing devices. These computing devices include, but are not limited to, tablet computers, mobile telephones, media players, handheld devices, laptop computers, personal digital assistants, and the like.

The shimless button assembly 100 may include a button cover 105. The button cover 105 may be coupled to a button frame or other button component (not shown). In certain embodiments, the button cover 105 is configured to be flush, or substantially flush, with a housing 110 of a computing device. The button cover 105 may also be configured to receive user actuation which causes the button cover 105 to move within the housing 110. Although a specific shape and orientation of the button cover 105 is shown in FIG. 1, it is contemplated that the button cover 105 may have any desired shape or orientation. Further, it is contemplated that the button cover 105 may sit at least partially above the housing 110 or below the housing 110.

As will be explained in more detail below, the button assembly 100 also includes a contact plate 145, a switch mechanism 150 and a printed circuit 160 coupled to the switch mechanism 150. In certain embodiments, the switch mechanism 150 is a tactile switch and the printed circuit 160 may be a flexible printed circuit. As shown in FIG. 1, the printed circuit 160 may be coupled to a base portion 165. The base portion 165 may be a substrate or an inner portion of a housing of a computing device. In embodiments, when the button cover 105 is actuated by a user, the contact plate 145 moves toward the switch mechanism 150 and causes the switch mechanism 150 to come into contact with the printed circuit 160. The printed circuit 160 then sends a signal to a processor (not shown) of the computing device in which the button assembly 100 is located.

In certain embodiments, a volume of space may be located in the button assembly 100 between the contact plate 145 and the switch mechanism 150. As discussed above, the volume of space may be caused by differing tolerances between one or more components of the button assembly 100. Accordingly, one or more embodiments of the present disclosure provide for an expansion component that is disposed within the button assembly 100. As will be explained below, the expansion component is configured to occupy the volume of space caused by the tolerances of each of the components in the button assembly 100.

As shown in FIG. 1, the expansion component of the button assembly 100 may include a compressible member 135. In one or more embodiments, the compressible member 135 is disposed between a portion of the button cover 105 and the contact plate 145. However, it is contemplated that the compressible member 135 may be placed in different locations within the button assembly 100 such as will be described below with reference to FIG. 3.

The compressible member 135 may be comprised of a rubber, foam, a spring or other malleable metal. As such, the compressible member 135 may be able to expand and contract based on the volume of space between the contact plate 145 and the switch mechanism 150. For example, the compressible member 135 may have an uncompressed thickness of 0.4 mm. However, the volume of space between the contact plate 145 and the switch mechanism 150 may be 0.2 mm. Accordingly, during construction of the button assembly 100, the compressible member 135 may be coupled to the contact plate 145 and to a portion of the button cover 105 as shown in FIG. 1 and then compressed to a thickness of 0.15 mm. When the compressible member 135 is placed into the button assembly 100 and released or enabled to expand, the compressible member 135 will expand to occupy the 0.2 mm volume of space caused by the tolerances of the contact plate 145 and the switch mechanism 150. Specifically, the compressible member 135 will expand and exert a force on the contact plate 145 which causes the contact plate 145 to come into contact with the switch mechanism 150. However, in certain embodiments the compressible member 135 does not exert enough force on the contact plate 145 to cause the contact plate 145 to begin actuating the switch mechanism 150. In embodiments, the compressible member 135 expands only until the volume of space caused by the tolerances of the various components of the button assembly 100 is occupied.

Although specific measurements are discussed above, it is contemplated that the compressible member 135 may have different thicknesses. Further, it is contemplated that the volume of space caused by the tolerances of the various components may vary. For example, one button assembly may have a volume of space of 0.3 mm while another button assembly may have a volume of space of 0.1 mm. Regardless of the volume of space in a given button assembly, the compressible member 135 may cause the contact plate 145 move in a direction toward the switch mechanism 150 to occupy the volume of space so that the contact plate 145 is biased against the switch mechanism 150.

Once the compressible member 135 has expanded to occupy the volume of space, a glue layer 140 is inserted into the button assembly 100. Although the glue layer may be inserted at this point, it is contemplated that the glue layer 140 may be inserted into the button assembly at any point in the assembly process. In certain embodiments, the glue layer 140 is contained within a boundary defined by the compressible member 135. For example, the compressible member 135 may have a circular or rectangular shape. Accordingly, the glue layer 140 is inserted into a center "cut-out" portion of the compressible member 135. As such, the glue layer 140 is prevented from escaping the boundary formed by the compressible member 135. Once the glue layer 140 hardens, the glue layer 140 prevents the compressible member 135 from further expansion or contraction. Accordingly, the volume of space caused by the tolerance stack of the various components of the button assembly 100 will continuously be occupied by the compressible member 135, the contact plate 145 and the glue layer 140.

Figure 2:
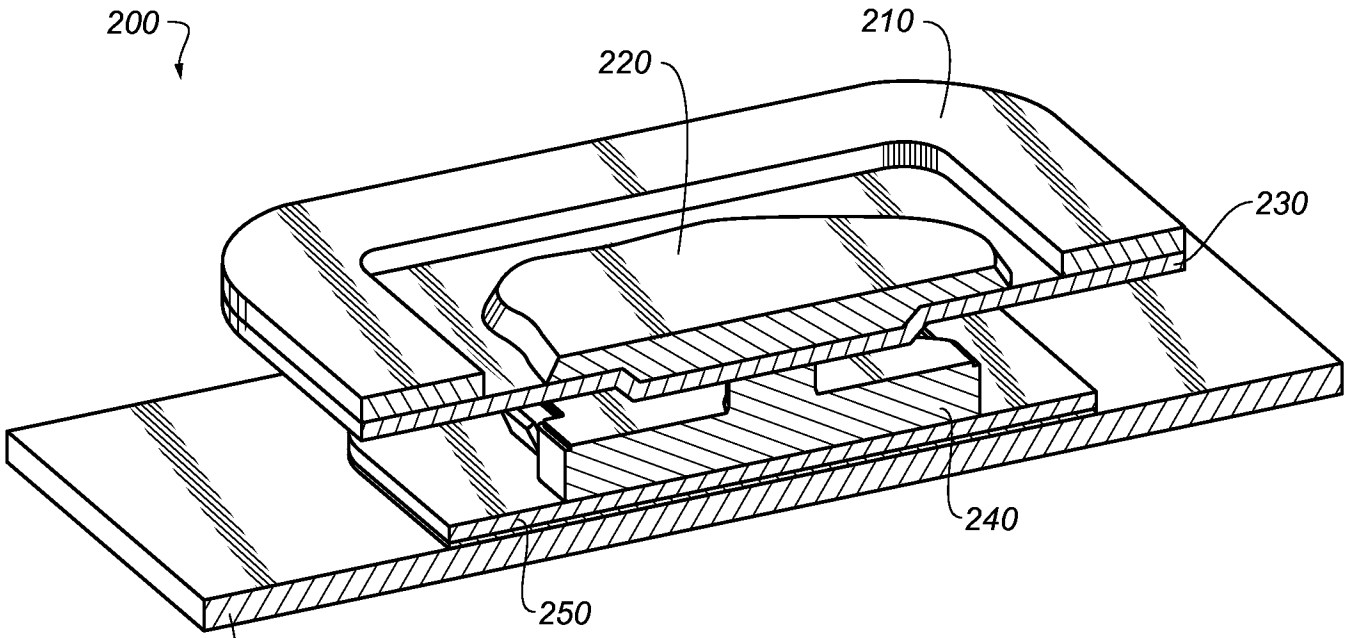
FIG. 2 illustrates a cross-sectional view of a partial button assembly according to one or more embodiments of the present disclosure.

FIG. 2 illustrates a cross-sectional view of a partial button assembly 200 according to one or more embodiments of the present disclosure. In certain embodiments the partial button assembly 200 may be part of the button assembly 100 of FIG. 1. As shown in FIG. 2, the button assembly 200 comprises a compressible member 210, a contact plate 230, a switch mechanism 240 and a printed circuit 250. The entire button assembly 200 may be coupled to a base layer 260. In certain embodiments, the base layer may be another circuit board, a substrate or an inner portion of a housing of an electronic device in which the button assembly 200 is located.

In embodiments, the compressible member 210 may be comprised of a compressible foam, a compressible rubber or a malleable metal. Although specific examples are given, it is contemplated that the compressible member 210 may be comprised of any material or combinations of materials that may be compressed and expanded such as described herein. As also shown in FIG. 2, the compressible member 210 may have a rectangular or square shape that defines an area within the compressible member 210. The area within the compressible member 210 may be configured to form a boundary in which a glue layer 220 may be deposited.

The compressible member 210 may be coupled to a contact plate 230. As also shown in FIG. 2, the compressible member 210, when coupled to the contact plate 230, may define an area in which a glue layer 220 may be deposited. As discussed above, the glue layer 220, when hardened, is configured to hold or secure the compressible member 210 at an expansion point in which the compressible member 210 and the contact plate 230 occupy a volume of space caused by the different tolerances of the various components within the button assembly 200. Specifically, the glue layer 220 is configured to hold the bias between the contact plate 230 and the switch mechanism 240 established by the compressible member 210.

For example, and as shown in FIG. 2, the button assembly 200 may include a switch mechanism 240. As previously discussed, the compressible member 210 is configured to exert a force on the contact plate 230 which causes the contact plate 230 to be biased against the switch mechanism 240. In certain embodiments, when the contact plate 230 is biased against the switch mechanism 240, the contact plate 230 will not begin to actuate the switch mechanism 240. In certain embodiments, and as will be shown below with respect to FIG. 3, the compressible member 210 may be positioned below the switch mechanism 240. As such, the compressible member 210 may exert a force on a bottom portion of the switch mechanism 240. As such, the switch mechanism 240 moves toward a contact plate 230 until the switch mechanism 240 occupies a volume of space caused by different tolerances in the button assembly 200.

Figure 3:
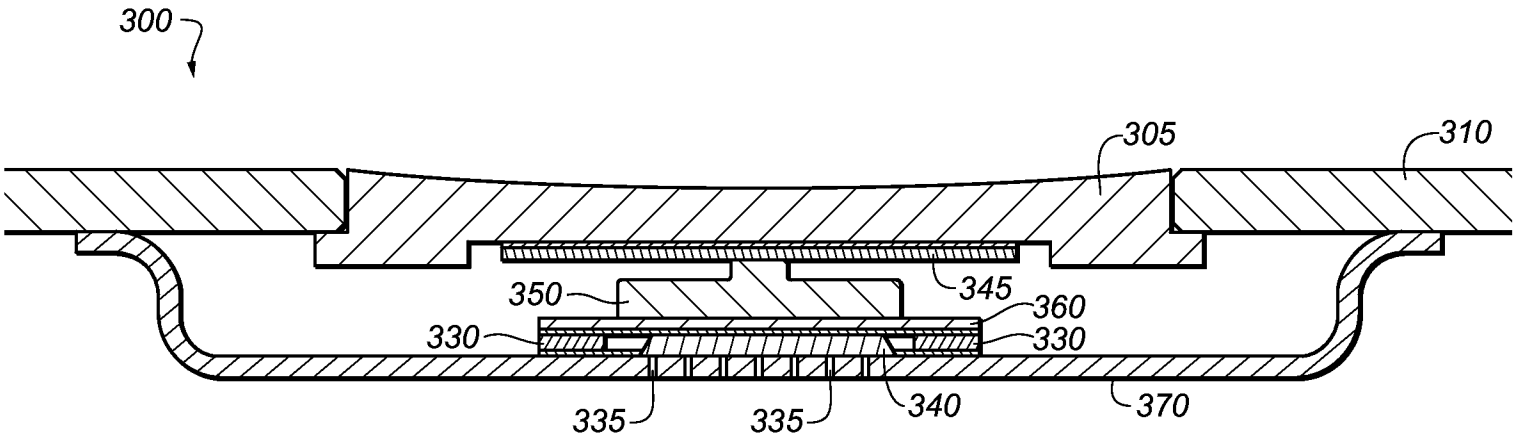
FIG. 3 illustrates a shimless button assembly according to one or more additional embodiments of the present disclosure.

FIG. 3 illustrates a shimless button assembly 300 according to one or more additional embodiments of the present disclosure. As with the shimless button assembly 100 shown and described above with respect to FIG. 1, the shimless button assembly 300 shown and described with respect to FIG. 3 may also be used in a variety of computing devices. As discussed above, the computing devices may include tablet computers, mobile telephones, media players, hand-held devices, laptop computers, personal digital assistants, and the like.

Referring to FIG. 3, the shimless button assembly 300 may include a button cover 305. In certain embodiments, the button cover may be coupled to a button frame or other button component (not shown). The button cover 305, or portions thereof, may be configured to be flush, or substantially flush, with a housing 310 of a computing device in which the button assembly 300 is located. In certain embodiments, the button cover 305 is configured to receive user actuation which causes the button cover 305 to move in the direction of the applied force.

The button assembly 300 may also include a contact plate 345, although in this particular configuration, a contact plate 345 may be optional. The button assembly 300 may also include a switch mechanism 350 and a printed circuit 360 coupled to the switch mechanism 350. As shown in FIG. 3, the button assembly 300 may also include an expansion component located beneath the switch mechanism 350 and the circuit board 360. The expansion component may be comprised of a compressible member 330 that is configured to expand and contract based on a tolerance stack of various components of the button assembly 300. For example, a volume of space may exist between the switch mechanism 350 and the contact plate 345 (if present) or a portion of the button cover 305.

In certain embodiments, the compressible member 330 is comprised of a rubber, foam, a spring or other malleable metal. As such, the compressible member 330 is able to expand and contract based on a volume of space between the contact plate 345 or a portion of the button cover 305 and the switch mechanism 350. As discussed above, the compressible member 330 is configured to exert a force on the switch mechanism 350 to cause the switch mechanism 350 to move toward the contact plate 345 or a portion of the button cover 305. However, the compressible member 330 does not exert enough force to cause the switch mechanism to being actuating when it comes into contact with the contact plate 345 or the portion of the button cover 305. In embodiments, the compressible member 330 continues to expand from a compressed state only until the volume caused by the tolerance stack of the various components of the button assembly 300 is occupied.

Once the compressible member 330 has expanded to occupy the volume of space, a glue layer 340 may be inserted into a boundary defined by the compressible member 330. As shown in FIG. 3, a base layer 370 of the button assembly 300 may have one or more openings or conduits 335 that enable the glue layer 340 to be inserted into the open center portion or "cut-out" portion of the compressible member 330. In other embodiments, the glue layer may be inserted or placed on one or more components of the button assembly 300 prior to the button assembly 300 being assembled. In embodiments, the compressible member 330 may prevent the glue layer 340 from escaping a boundary formed by the compressible member 330. Although an open center portion or "cut-out" portion is specifically mentioned, it is contemplated that the glue layer 340 may be inserted directly into the compressible member 330.

Once the glue layer 340 hardens, the glue layer 340 prevents the compressible member 330 from further expansion or contraction. Accordingly, the volume of space caused by the tolerances of the various components will be continuously occupied by the compressible member 330, the switch mechanism 350 and the glue layer 340.

Figure 4B:
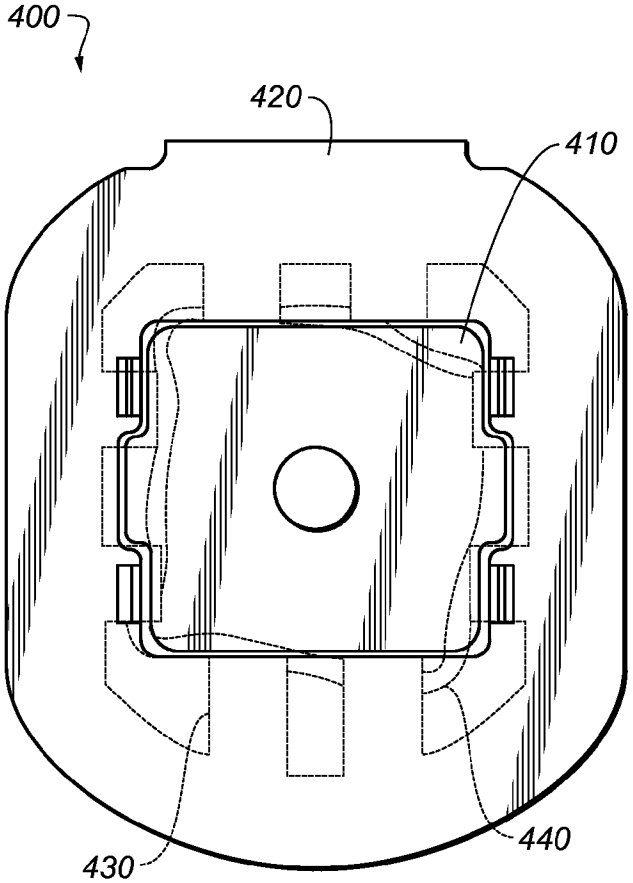
FIGS. 4A and 4B illustrate a close-up view of one or more components of the shimless button assembly according to one or more embodiments of the present disclosure.
Figure 4A:
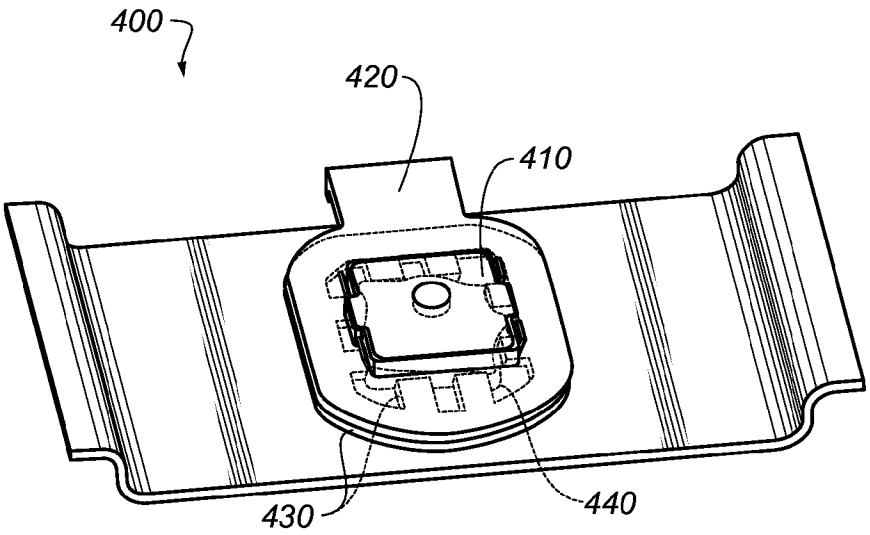

FIGS. 4A and 4B illustrate a close-up view of one or more components of a shimless button assembly 400 according to one or more embodiments of the present disclosure. In certain embodiments, the partial button assembly 400 may be the expansion mechanism described above with respect to FIG. 3.

Specifically, the partial button assembly 400 may include a tactile switch 410 coupled to a circuit board 420. As discussed above with respect to FIG. 3, a bottom side of the circuit board 420 may be coupled to a compressible member 430 that causes the printed circuit board 420 and the switch mechanism 410 to move from a first position to a second position based on a volume of space between the switch mechanism 410 and a contact plate or a button frame of a button assembly. As also discussed above, a glue layer 440 may be inserted within an area defined by a compressible member 430. The glue layer, when hard, prevents the compressible member 430 from further expansion and contraction. As such, the partial button assembly 400 would occupy a volume of space caused by differing tolerance levels in the button assembly 400 without the use of one or more shims.

Figure 5:
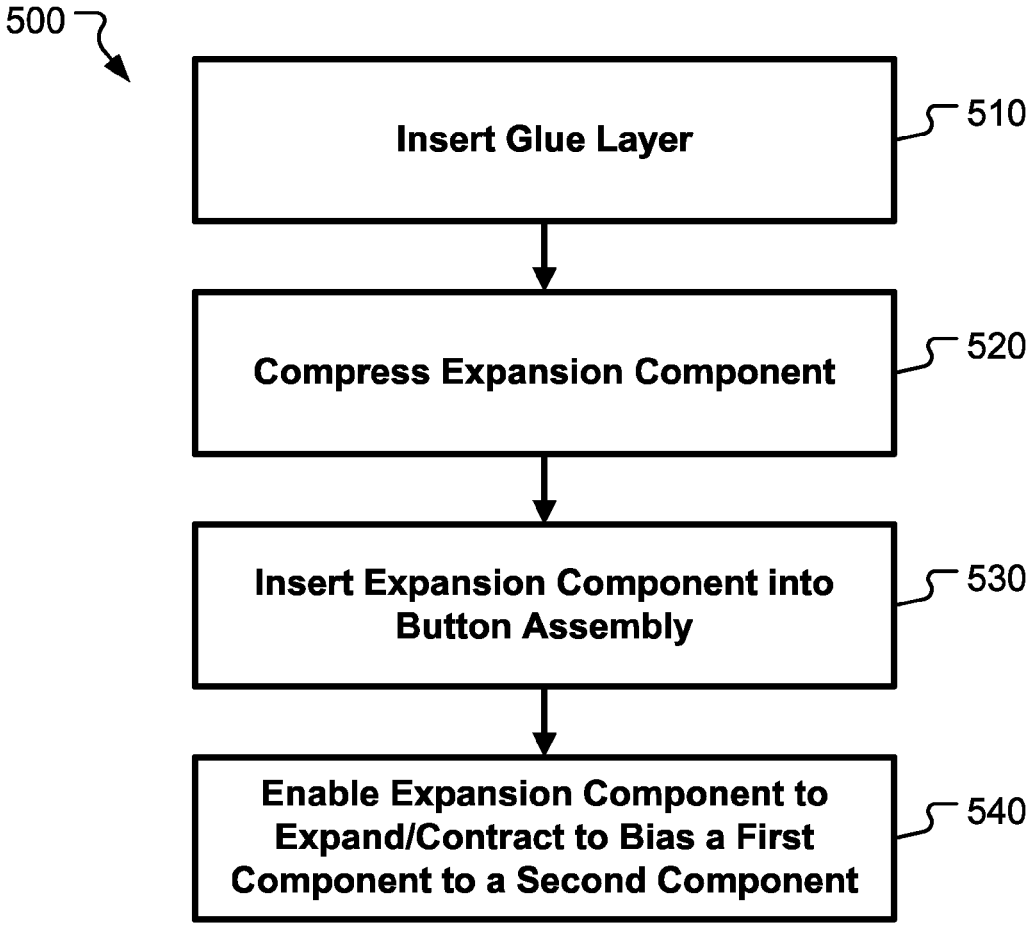
FIG. 5 illustrates a method for biasing a button assembly according to one or more embodiments of the present disclosure.

FIG. 5 illustrates a method 500 for biasing a button assembly according to one or more embodiments of the present disclosure. In embodiments, the method 500 for biasing a button assembly may be used with one or more embodiments described above with references to FIGS. 1-4. Accordingly, one or more references may be made to one or more components described above with respect to FIGS. 1-4.

Method 500 begins when a glue layer is placed 510 onto one or more components of a button assembly. In certain embodiments, the glue layer may be placed within a boundary defined by one or more components of an expansion component of the button assembly. For example, a compressible member of an expansion component of the button assembly may define an area in which the glue layer is placed. As will be discussed below, once the button assembly has been assembled and the glue layer hardens, the glue layer prevents the expansion component from further expansion and contraction even when the button is subsequently actuated by a user. As a result, and as discussed above, the expansion component continues to occupy the volume of space in the button assembly caused by a tolerance stack between the various components of the button assembly. Although a glue layer is specifically mentioned herein, it is contemplated that materials other than glue may be used so long as the material prevents the expansion component from further expansion and contraction after biasing one or more components of the button assembly.

Flow then proceeds to operation 520 in which an expansion component is compressed and inserted 530 into a button assembly. The expansion component may be a compressible member comprised of a foam material, a rubber material, a malleable metal or other such material such as described above. In certain embodiments, the expansion component may be comprised of one or more additional components of the button assembly. For example, the expansion component may be comprised of a compressible member and a contact plate. In another embodiment, the expansion component may be comprised of a compressible member, a printed circuit and a switch mechanism.

Once the expansion component has been placed in the button assembly, flow proceeds to operation 540 and the expansion component either expands or further contracts based on a tolerance stack caused by various components in the button assembly. For example, the button assembly may have a 0.3 mm space between the contact plate and the switch mechanism. This space may be caused by a manufacturing tolerance of one or more components of the button assembly. Further, the expansion component may have an uncompressed thickness of 0.4 mm. Accordingly, during construction of the button assembly, the expansion component may be compressed to a thickness of 0.15 mm and inserted into the button assembly. The expansion component is then enabled to expand to occupy the 0.3 mm volume of space caused by the tolerance stack. Specifically, the expansion component will bias one component of the button assembly to a second component of the button assembly such as described above.

Once the volume of space has been occupied by the expansion component, the glue layer is allowed to harden such as discussed above. The glue layer then maintains the bias established by the expansion component even when the button is subsequently actuated by a user.

The description and illustration of one or more embodiments provided in this disclosure are not intended to limit or restrict the scope of the present disclosure as claimed. The embodiments, examples, and details provided in this disclosure are considered sufficient to convey possession and enable others to make and use the best mode of the claimed embodiments. Additionally, the claimed embodiments should not be construed as being limited to any embodiment, example, or detail provided above. Regardless of whether shown and described in combination or separately, the various features, including structural features and methodological features, are intended to be selectively included or omitted to produce an embodiment with a particular set of features. Having been provided with the description and illustration of the present application, one skilled in the art may envision variations, modifications, and alternate embodiments falling within the spirit of the broader aspects of the embodiments described herein that do not depart from the broader scope of the claimed embodiments.

We claim:

1. A button assembly, comprising:

a button component;

a base positioned below the button component;

a switch mechanism positioned between the base and the button component; and a compressible member positioned between the base and the button component and defining a cavity;

a hardenable material positioned within the cavity, wherein:

the compressible element is compressible to expand or contract to occupy a volume within the button assembly;

when the hardenable material cures, the hardenable material becomes rigid and maintains a thickness of the volume occupied by the compressible element.

2. The button assembly of claim 1, wherein the hardenable material comprises a glue.

3. The button assembly of claim 1, further comprising a printed circuit coupled to the switch mechanism.

4. The button assembly of claim 1, wherein the compressible member is comprised of foam.

5. The button assembly of claim 1, wherein the compressible member is comprised of rubber.

6. The button assembly of claim 1, wherein the button component comprises a contact plate.

7. The button assembly of claim 6, wherein the compressible member is disposed between the button component and the contact plate.

8. A button assembly, comprising:

a button component;

a base positioned below the button component;

a switch mechanism positioned between the base and the button component;

an expansion component positioned within a volume located between the button component and the switch mechanism or between the switch mechanism and the base; and a glue positioned within a cavity defined within the expansion component, wherein:

the expansion component comprises a compressible member that expands or contracts to occupy a thickness of the volume;

the glue, once hardened, maintains the thickness after curing.

9. The button assembly of claim 8, further comprising a printed circuit coupled to the switch mechanism, wherein the printed circuit board is positioned between the switch mechanism and the expansion component.

10. The button assembly of claim 8, wherein the compressible member is comprised of foam.

11. The button assembly of claim 8, wherein the compressible member is comprised of rubber.

12. The button assembly of claim 8, wherein the button component comprises a contact plate.

13. The button assembly of claim 8, wherein the compressible member is coupled to a housing component.

14. The button assembly of claim 13, wherein the housing component has at least one insertion point, wherein the insertion point enables the glue layer to be disposed within the cavity defined within the expansion component.

15. The button assembly of claim 8, wherein the compressible member is comprised of a malleable metal.

16. The button assembly of claim 8, wherein the compressible member is a spring.

17. A method for biasing a button assembly, the method comprising:

placing a glue layer into a cavity defined by a compressible member;

inserting the compressible member into a volume of the button assembly to bias a button component away from a base; and hardening enabling the glue layer to maintain a thickness of the volume.

18. The method of claim 17, wherein the compressible member is disposed between the contact plate and a portion of a button.

19. The method of claim 17, wherein the compressible member comprises at least one of foam and rubber.

20. The method of claim 17, further comprising enabling the compressible member to expand prior to the glue layer hardening.

* * * * *